United States Patent [19]

Siegel

[11] Patent Number: 4,615,045

[45] Date of Patent: Sep. 30, 1986

[54] PILFER PROOF HANGUP BAG STRUCTURE AND METHOD

[75] Inventor: Karl-Heinz Siegel, Nuremberg, Fed. Rep. of Germany

[73] Assignee: Minigrip, Inc., Orangeburg, N.Y.

[21] Appl. No.: 667,101

[22] Filed: Nov. 1, 1984

[30] Foreign Application Priority Data

Nov. 2, 1983 [DE] Fed. Rep. of Germany ..... 3339653

[51] Int. Cl.[4] ..... B65D 33/34

[52] U.S. Cl. ..... 383/5; 206/807; 383/9; 383/35; 383/65; 383/95; 493/215

[58] Field of Search ..... 383/5, 9, 35, 93, 95, 383/63, 65, 61; 24/576, 587; 493/194, 198, 214, 215; 206/806, 807

[56] References Cited

U.S. PATENT DOCUMENTS

| | | | |
|---|---|---|---|
| 2,480,500 | 8/1949 | Moore | 383/35 X |
| 3,172,443 | 2/1962 | Ausnit . | |
| 3,226,787 | 5/1962 | Ausnit . | |
| 3,425,469 | 4/1966 | Ausnit . | |
| 3,473,589 | 10/1969 | Gotz . | |
| 3,509,927 | 5/1970 | Hasty et al. . | |
| 3,679,511 | 7/1972 | Ausnit | 383/63 X |
| 3,827,472 | 8/1974 | Uramoto | 383/61 X |
| 4,000,768 | 1/1977 | Siegel . | |
| 4,290,467 | 9/1981 | Schmidt . | |
| 4,304,615 | 12/1981 | Siegel . | |
| 4,363,345 | 12/1982 | Scheibner | 383/65 X |

*Primary Examiner*—William Price
*Assistant Examiner*—Bryon Gehman
*Attorney, Agent, or Firm*—Hill, Van Santen, Steadman & Simpson

[57] ABSTRACT

A pilfer proof hangup bag structure having a bag top separable closure including fastener strips carrying extruded plastic profiles from which pull flanges extend upwardly. One of the pull flanges has an upward hangup header extension. A pilfer proof tongue of thin folded film web is attached in closing relation to the top from the bag attachment to ribs at the top of the pull flanges. Adjacent to the ribs the tongue has fracture lines to facilitate rupturing and removal of the tongue when access into the bag is desired.

18 Claims, 4 Drawing Figures

PILFER PROOF HANGUP BAG STRUCTURE AND METHOD

The present invention relates to hangup bags which may be at least in part made from synthetic plastic material, and is more particularly concerned with a new and improved pilfer proof hangup bag and method of making the same.

By way of example U.S. Pat. Nos. 3,509,927, 4,000,768, 4,290,467 and 4,304,615 are referred to as disclosing various bag structures having carrying handles or upper end hangup tabs on headers.

Also, by way of example, U.S. Pat. Nos. 3,172,443 and 3,226,787 are referred to as showing various pilfer proof bag structures.

U.S. Pat. No. 3,425,469 shows an arrangement with pull flanges having ribs thereon.

In U.S. Pat. No. 3,473,589 thinning tear lines are provided on a tamper-proof closure.

However, the just discussed U.S. patents do not embody the concept of providing a zipper equipped reclosable bag having both a hangup header and a pilfer proof closure means.

It is therefore an important object of the present invention to provide a new and improved hangup bag which has pilfer proof means which will prevent unauthorized persons from gaining access to contents of the bags without leaving a tampering telltale, namely, damage to or destruction of a pilfer proof means, but which pilfer proof means can be readily broken for access to the contents by an authorized person such as a purchaser of bagged merchandise.

To this end, the present invention provides a new and improved pilfer proof hangup bag structure, which comprises bag top separable closure means including confronting fastener strips having inside faces wherein a first extruded plastic profile extends along one of the faces for separable engagement with a complementary second extruded plastic profile along the other of said faces, a first pull flange coextensive in length with the strips extending upwardly from the first profile, a second pull flange coextensive in length with the strips and having an upward extension extending upwardly from the second profile to a substantially greater height than the first pull flange and providing a header having hangup means, and a rupturable pilfer proof tongue attached to and along both of the pull flanges and preventing access past the pull flanges and the separable fastener means until the tongue is ruptured.

A new and improved method of making the pilfer proof hangup bag structure is also provided.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which.

Figure 1:
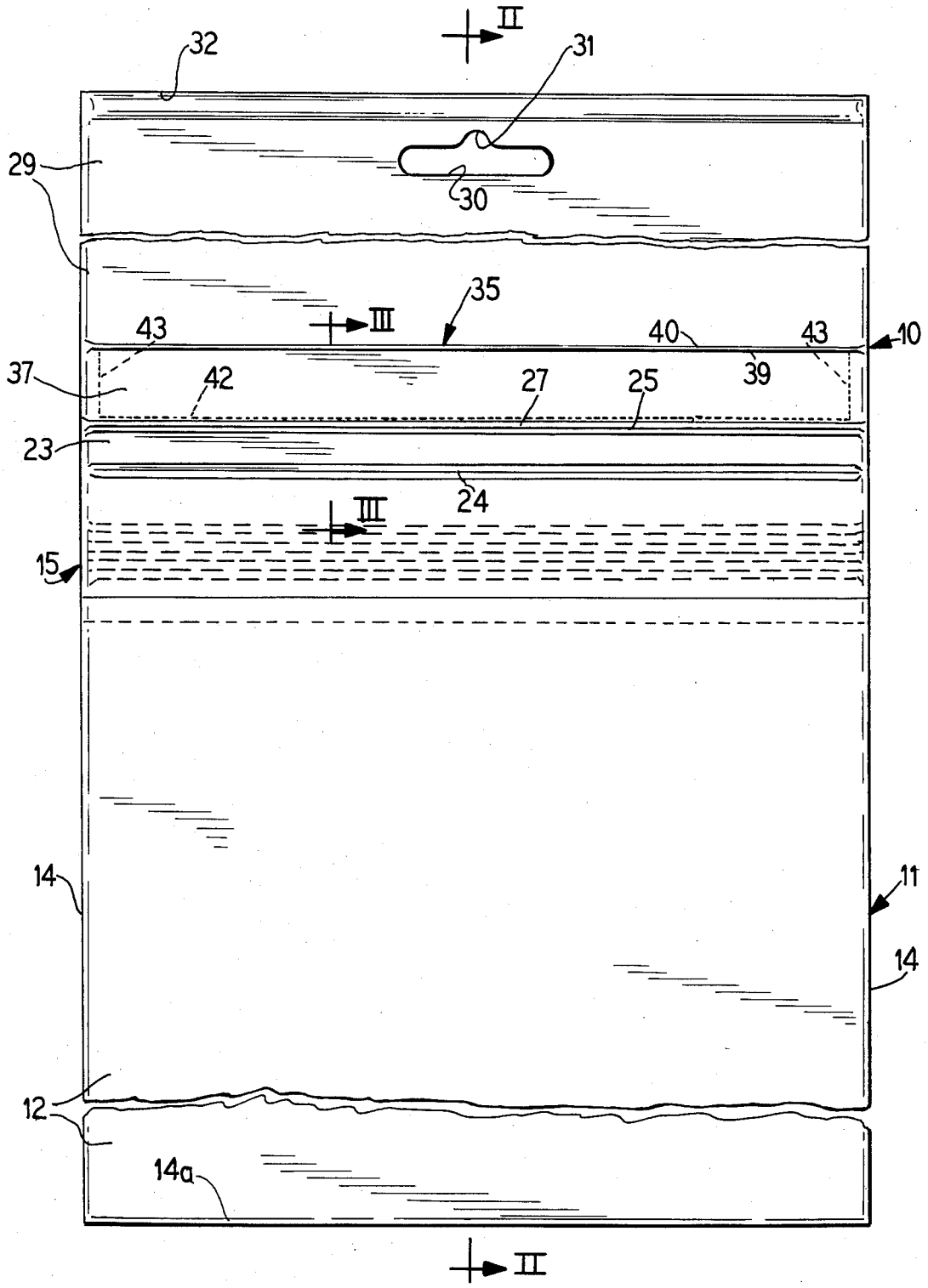
FIG. 1 is a fragmental front elevational view of a bag embodying the invention.
Figure 2:
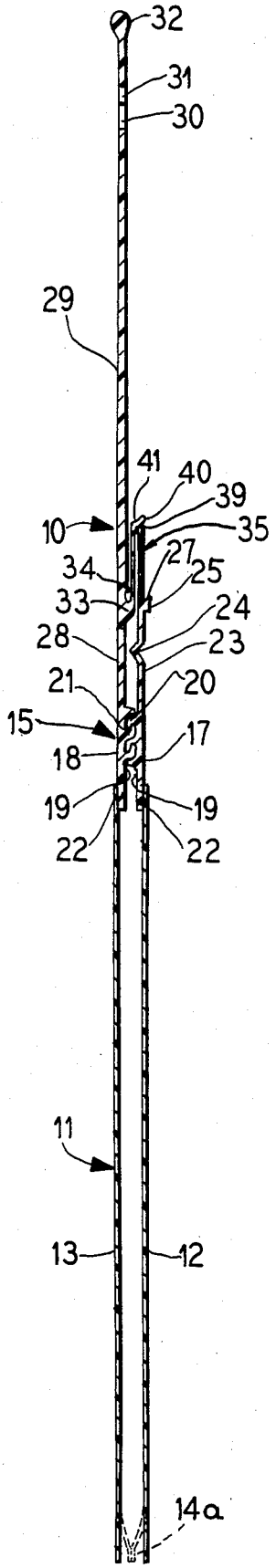
FIG. 2 is a vertical sectional detail view taken substantially along the line II—II in FIG. 1.
Figure 3:
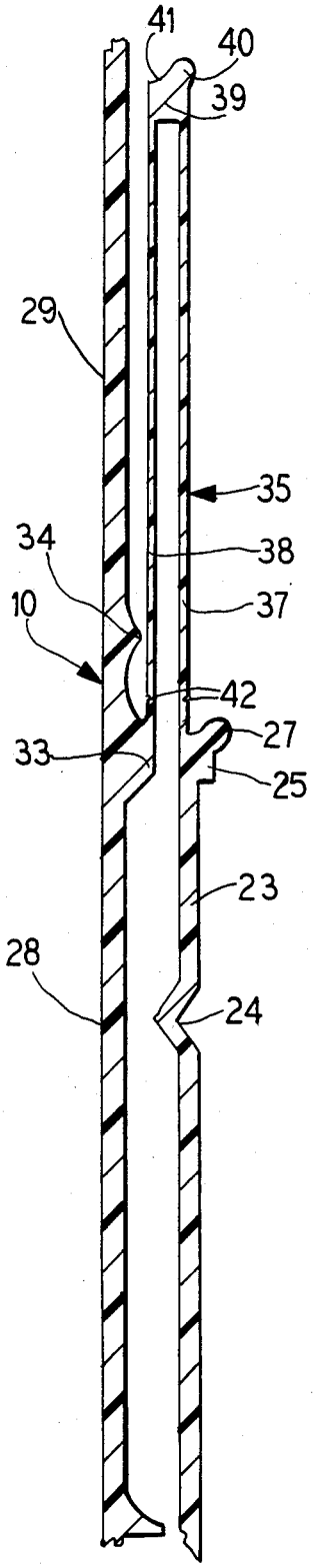
FIG. 3 is a fragmentary greatly enlarged sectional detail view taken substantially along the line III—III in FIG. 1.

A preferred embodiment of the bag as shown in FIGS. 1 and 2 comprises a pilfer proof hangup top structure 10 and a bag body 11. Both of the bag top 10 and body 11 are preferably made from suitable synthetic plastic material. Such material in several varieties is well known in the art and therefore need not be described in detail. Although the bag body 11 may be extruded plastic film, other materials such as paper, paper and plastic composite, and the like, may be used. Although each of the bag top structure 10 and bag body 11 are by preference formed as separate units and then joined into the final product, they may, if preferred, be formed as one integral extrusion, according to techniques well known in the art. Such integral extrusion, however, limits the type of material that may be used, and may be beset by the problem that it is generally referred to have the bag body material formed from film of much thinner section modulus then a preferred section modulus for the bag top structure 10. Both the bag top structure 10 and the bag body 11 may be formed by separately extruding continuous lengths which are, generally after being thus preformed, fed to an assembly line, joined and then separated into bag sections before or after filling of the sections with a desired contents product.

As shown, the bag body 11 comprises a front wall panel 12 and a back wall panel 13 which may, in common with the top structure 10, be provided with heat sealed seams 14 along the opposite sides of the completed bag section. The bottom of the bag may be left open for filling and then similarly heat seal seamed closed as indicated at **14*a* in dash outline in FIGS. 1 and 2**.

An important feature of the bag top structure 10 is bag top separable closure means generally identified at 15 and including complementary fastener strips 17 and 18 having inside confronting faces 19. The fastener strip 17 has along its innerface 19 extruded plastic separable fastener profile 20 and the strip 18 has along its innerface 19 complementary extruded separable fastener profile 21. The separable fastener profiles 20 and 21 may be of any preferred pressure engageable and pull apart separable construction, being herein shown as of the equal and opposite multirib and groove type.

Each of the fastener strips 17 and 18 has extending from its fastener profile toward the bag body 11 a respective attachment flange 22 which is adapted to be secured to the top ends of the bag walls in any desired manner, either by fusion or adhesively in accordance with well known techniques. Thus, the attachment flange 22 of the fastener strip 17 is shown as permanently attached to the bag wall 12 and the attachment flange 22 of the fastener strip 18 is shown as permanently attached to the bag wall 13. In effect the fastener strips become parts of the bag walls 12 and 13.

A first pull flange which is coextensive in length with the strips 17 and 18 extends upwardly from the profile 20 on the strip 17 and is of a width which will facilitate grasping and pulling the fastener profiles 20 from the fastener profiles 21. Intermediate its length, the pull flange 23 may be provided with a longitudinal indentation 24 parallel to the fastener profiles 20 and 21 and adapted for more easily grasping and bending manipulation of the upper portion of the pull flange 23. Along its upper edge, the pull flange 23 has a reinforcing rib 25 of a desirable width and provided with a rounded bead 27 also facilitating manipulation of the pull flange as well as stabilizing the pull flange structure. Desirably, the entire rib 25 including the bead 27 or only the bead 27 may be of a contrasting color, such as red, to afford easier recognition of the pull flange 23 by the user.

A second pull flange 28 coextensive in length with the strips 17 and 18 extends upwardly from the profile 21 on the strip 18 to about the same height as the first pull flange 23. An upward extension from the pull flange 28 to a substantially greater upward width than the first pull flange 23, such as three or four times the width of the pull flange 23, provides a header 29 having hangup means preferably in the form of a horizontally elongated slot 30 having along its upper edge a hanger hook, or finger receiving, recess 31 located centrally in the top portion of the header. Advertising indicia may be applied to the header 29 by imprinting in any preferred manner. A bead 32 extending along the top edge of the header 29 provides stabilizing reinforcement, especially for withstanding downward pull exerted by contents of the bag in a hangup merchandising display. Additional stability against load imposed distortion of the pull flange 28 and its header extension 29 is provided by a reinforcing rib 33 opposite the rib 25 on the pull flange 23 and desirably of a substantially greater section modulus and thus mass then the rib 25 because of the greater reinforcing function required of the rib 33. In addition, the lower portion of the header 29 above where it joins the rib 33 has a ridge-like auxiliary reinforcing rib 34 of less thickness then the reinforcing rib 33 and in addition to its load stabilizing function in respect to the lower end of the header 29 has a spacer function as will be described.

According to the present invention the bag top structure 10 is provided with a pilfer proof tongue 35 attached to and along both of the pull flanges 23 and 28 as a closure over the top opening of the bag for preventing access past the pull flanges and the separable fastener means 15 toward the interior of the bag until the tongue is ruptured. To this end, the pilfer proof tongue 35 comprises a plastic web fold which is preferably of a substantially thinner section modulus then either of the pull flanges 23 and 28. One wall 37 of the tongue 35 is integrally attached to the upper end of the pull flange 23 at the rib 25. The other wall 38 of the tongue is integrally attached to the pull flange 28 at the reinforcing rib 33, and desirably along the top forward edge of the rib 33 so that there is a spaced relation between the tongue wall 38 and the lower portion of the header 29 which the wall 38 confronts. Here it will be noted that the auxiliary rib 34 acts together with the rib 33 as spacer means which will tend to keep the tongue 35 spaced from the header 29 to facilitate engagement of the tongue 35 when desired.

Along its upper edge, the tongue 35 desirably has a reinforcing rib 39 to which the tongue walls 37 and 38 are attached in spaced relation. This rib 39 serves to stabilize the thin walled tongue 35 against collapsing as a result of gravitational pull. To facilitate digital manipulation of the tongue 35, should it be deflected against the header 29, the upper edge of the rib 39 is provided with an upwardly and outwardly projecting bead 40 which overlies the outer or front wall 37 of the tongue. Along its back side and generally aligned over the back wall 38 of the tongue, the bead 40 has a groove depression 41 having an upwardly and outwardly convergent cam surface which assists in a tongue grasping maneuver.

Means are provided which will maintain the pilfer proof tongue 35 intact until it is deliberately ruptured. To this end, the base edge of the tongue 35, that is the end portions of the tongue walls 37 and 38 adjacent to the ribs 25 and 33 to which they are respectively attached, is provided with a weakening which will facilitate rupturing of the tongue when desired, by tearing it free from the pull flanges 23 and 28. Conveniently such rupture facilitating means comprise fracture lines of serrations or perforations 42 along the length of the lower ends of the tongue walls 37 and 38.

Since the tongue 35 as well as the rest of the bag top structure 10 extends throughout the width of the bag and thus the opposite ends of the fastener strips 17 and 18 and the pull flanges 23 and 28 as well as the opposite ends of the tongue 35 are sealed within the seams 14 at the opposite sides of the bag, the tear facilitating means, i.e. the fracture lines of weakening 42 are desirably extended across the opposite ends of the tongue 35 in weakening or fracture facilitating extensions 43. If preferred, of course, the weakenings 42 and 43 may be simply line thinnings effected at the same places as the perforations but formed by partially fusing the tongue elements by die produced heat during manufacture of the bag top structure 10.

Figure 4:
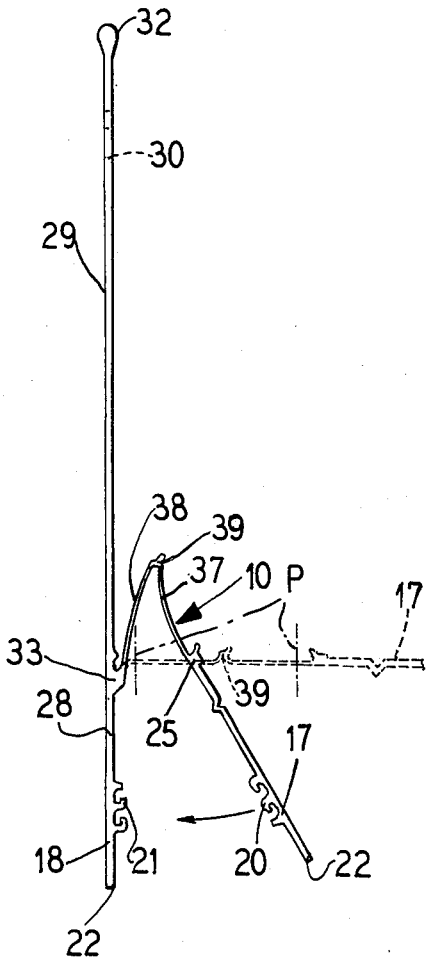
FIG. 4 is a side elevational view of an integral one-piece extrusion for providing the pilfer proof hangup bag structure adapted to be combined with a bag body.

In a preferred method of making the bag top closure structure 10, the fastener strips 17 and 18, together with the pull flanges 23 and 28, respectively, and the header 29, as well as the pilfer proof tongue 35 may be formed, as by extrusion, as a one piece unit from suitable plastic material and wherein the complementary fastener profiles 20 and 21 are unengaged and spaced apart with their strips 17 and 18, substantially as shown in full line in FIG. 4. After the extrusion has thoroughly set, the lines of weakening may be formed in the base and end portions of the tongue 35 by any means appropriate for the purpose, such as punches, thinning dies, or the like, indicated by the lines P on the dot-dash spread open arrangement shown to facilitate this step in the making of the structure. Thereafter, the structure may be collapsed on itself and the fastener profiles 20 and 21 engaged, if desired and the continuous length of the completed structure may be wound on a drum or in a coil for subsequent assembly with the material of the bag body 11. On the other hand, the bag top closure structure 10 may, immediately after formation thereof as been completed, be run along a production line and assembled with and joined to the bag body walls 12 and 13. After the bag sections are completed and filled, they may be mounted on a hangup sales display.

A desirable attribute of the two part construction of the bag, that is separately preforming the bag top closure structure 10 and the bag body structure 11, is that the bag top closure structure 10 may be of a standardized size while the bag body structure 11 may vary as to bag size within a wide range, both as to width and length. If both of the structures 10 and 11 were to be made in a single extrusion, a separate die arrangement would have to be employed for each size of bag.

Unless the tongue 35 on the bag is intact, there would be an indication that access into the bag had been gained or at least attempted. On the other hand, if an authorized person wishes to gain access into the bag, the tongue 35 may be readily torn off by grasping the tongue in one hand while holding the top structure 10 below the tongue as by grasping it at and squeezing together the ribs 25 and 33 providing a firm gripping means, and pulling on the tongue to tear it off at the lines of weakening 42 and 43.

It will be understood that variations and modifications may be effected without departing from the spirit and scope of the novel concepts of the present invention.

I claim as my invention:

1. A pilfer proof hangup bag structure, comprising:

bag top separable closure means including confronting fastener strips for extending lengthwise across the bag top and having inside faces wherein a first extruded plastic profile extends along one of said faces and is separably engageable with a complementary second extruded plastic profile extending along the other of said faces;

a first pull flange coextensive in length with said strips and extending upwardly a limited distance from said first profile to a top end on the first pull flange;

a second pull flange coextensive in length with said strips, and extending upwardly from said second profile to a top end of said second pull flange at a height about the same as said first pull flange top end;

a header extension projecting to a substantial distance upwardly from a lower end attached to said second pull flange top end and having hangup means on its upper portion;

and a rupturable bag top closing pilfer proof tongue consisting of a folded web parallel to and spaced from said header extension having, when folded, opposite parallel walls having respective edges with one edge attached to and along said top end of said first pull flange and a second edge of said tongue attached to and along the top end of said second pull flange and at the lower end of said header, said walls having means for facilitating rupture along fracture lines adjacent to said edges above said first and second pull flanges for preventing access past said pull flanges and said separable fastener means into the associated bag top until said tongue is ruptured.

2. A structure according to claim 1, wherein both of said pull flanges have ribs extending along said ends, and said web edges are attached to said ribs.

3. A structure according to claim 1, wherein said second pull flange and said header have spaced parallel reinforcing and spacer ribs therealong, and one of said ribs having the second tongue web edge attached thereto.

4. A structure according to claim 1, wherein said first pull flange has a reinforcing and manipulation facilitating rib along its top end, and said edge of said tongue web being attached to said rib.

5. A structure according to claim 1, wherein all of said fastener strips, separable fastener profiles, pull flanges and pilfer proof tongue comprise one integral plastic unit.

6. A structure according to claim 1, wherein said tongue has a stabilizing and digitally engageable rib extending along said juncture fold.

7. A structure according to claim 6, wherein said rib has a bead therealong projecting away from said header facilitating digital manipulation of the rib.

8. A structure according to claim 1, wherein said first pull flange has a rib on its top end to which said first edge of said tongue is attached, and said rib has a bead thereon having a configuration which facilitates grasping the rib.

9. A structure according to claim 1, wherein each of said pull flanges has along its top end a longitudinally extending rib, said ribs being opposite one another, said tongue edges being attached to said ribs, means along said tongue adjacent to said ribs to facilitate rupturing of the tongue, and rupturing of the tongue being adaped to be effected by pressing said ribs together and pulling on the tongue away from said ribs for rupturing said rupture facilitating means.

10. In a plifer proof hangup bag formed from synthetic plastic material and having fastener profiles disposed at the inside of front and back walls of the bag and complementarily constructed for mutual engagement, the profiles being disposed in spaced relation below and parallel to a top opening from the bag along the top of the front wall so that the respective areas of the front and back walls between the closure profiles and the top opening profile a first pull flange on said front wall and a second pull flange on said back wall, and the back wall of the bag has an extension of considerable height beyond the paper end of the back wall pull flange and thereby provides a header upon which indicia may be carried and which is provided with a hangup hole adjacent to its upper edge, the improvement comprising:

a double wall upwardly folded pilfer proof tongue closed at an upper end fold and having one wall with a lower edge secured to the upper end of the front wall first pull flange and a second wall of the tongue being spaced from and parallel to said header extension and being parallel to said one wall, said second wall having a lower edge secured to the upper end of said second pull flange and the lower end of said upward header extension of the rear wall and at about the same height as said front wall pull flange;

and perforated fracture lines in said tongue walls adjacent to said edges of said tongue walls and above said pull flanges.

11. A bag according to claim 10, wherein spreader means are disposed at the inside of the lower portion of the upward header extension of the back wall of the bag, and said tongue second wall lower edge being attached to said spreader means.

12. A bag according to claim 11, wherein said spreader means comprises vertically spaced rib structures along the lower portion of said upward extension of the rear wall.

13. A bag according to claim 10, wherein said front wall pull flange has a horizontal indentation intermediate said profiles and said upper end of the front wall pull flange, facilitating bending of said pull flange.

14. A bag according to claim 10, wherein said front wall pull flange has a rib along its upper end which has a coloration to facilitate differentiating the upper end of the pull flange from the rest of the bag structure.

15. A method of making a pilfer proof hangup bag structure, comprising:

forming bag top separable closure means including complementary fastener strips for extending lengthwise across the bag top and having inside faces and equipping said inside faces with extruded plastic profiles wherein one of the profiles extends along one of said faces and is separably engageable with a complementary second extruded plastic profile extending along the other of said faces;

providing a first pull flange coextensive in length with said strips and extending upwardly a limited distance from said first profile to a top end of the first pull flange;

providing a second pull flange coextensive in length with said strips, and extending upwardly from said second profile to top end at a height about the same height as said first pull flange top end;

providing on said second pull flange an extension forming a header having on its upper end portion hangup means;

providing a rupturable bag top closing pilfer proof folded tongue having opposite parallel walls with respective edges and attaching on of said edges to and along the top end of said first pull flange and attaching the remaining edge of said tongue to the top of said second pull flange from which said header extends upwardly from said second pull flange so that said tongue is spaced from and parallel to said extension; and providing means for rupturing said walls along respective lines adjacent said edges and above said pull flanges for thereby preventing access past said pull flanges and said separable fastener means until said tongue is ruptured.

16. A method according to claim 15, which comprises forming all of said hangup bag structure as a one piece plastic unit.

17. A method according to claim 16, comprising forming said ends of the pull flanges with respective ribs, and attaching said tongue edges to said ribs.

18. A method according to claim 15, which comprises forming said pull flanges of a greater modulus section than said tongue.

* * * * *